United States Patent [19]

Lancaster et al.

[11] 4,255,918

[45] * Mar. 17, 1981

[54] COLLAPSIBLE WEB APPARATUS

[75] Inventors: Patrick R. Lancaster; William G. Lancaster, both of Louisville, Ky.

[73] Assignee: Lantech Inc., Louisville, Ky.

[ * ] Notice: The portion of the term of this patent subsequent to May 27, 1997, has been disclaimed.

[21] Appl. No.: 83,610

[22] Filed: Oct. 11, 1979

Related U.S. Application Data

[63] Continuation-in-part of Ser. No. 911,652, Jun. 1, 1978, Pat. No. 4,204,377, and Ser. No. 928,236, Jul. 26, 1978.

[51] Int. Cl.[1] ..... B65B 11/04

[52] U.S. Cl. ..... 53/556; 53/587

[58] Field of Search ..... 53/556, 587, 588, 211, 53/441

[56] References Cited

U.S. PATENT DOCUMENTS

| | | | |
|---|---|---|---|
| 4,077,179 | 3/1978 | Lancaster et al. | 53/556 X |
| 4,152,879 | 5/1979 | Shulman | 53/587 X |
| 4,204,377 | 5/1980 | Lancaster et al. | 53/587 X |

FOREIGN PATENT DOCUMENTS

| | | | |
|---|---|---|---|
| 2383074 | 10/1978 | France | 53/587 |

OTHER PUBLICATIONS

*The Digest* by Infra Pak, Dec. 1977.

*The Digest* by Infra Pak, Sep. 1977.

*Primary Examiner*—John Sipos

*Attorney, Agent, or Firm*—Gipple & Hale

[57] ABSTRACT

The present invention comprises a wrapping apparatus having a frame, a reciprocally driven carriage moveably mounted on the frame, the carriage being adapted to hold a rotatable roll of stretchable film material and a film width varying mechanism. A driven rotatable turntable adapted to support a load is positioned adjacent to the frame, and the leading edge of the film material is held adjacent the load. A brake is connected to the film roll to restrict movement of the web of material from the roll and the film width varying mechanism is mounted in the material path so that the film web travels through a pivotable "C" shaped assembly of the film width varying mechanism which when pivoted by spring action reduces the film web width, so that the film material is stretched and reduced in width as it leaves the roll. The carriage is driven along the frame in one direction to provide a wrap for a load and returns in an opposite direction while continuing to wrap the load, at which time the material web is severed from the material roll dispenser.

10 Claims, 15 Drawing Figures

COLLAPSIBLE WEB APPARATUS

RELATED APPLICATIONS

This is a continuation-in-part of U.S. Applications Ser. Nos. 911,652 now U.S. Pat. 4,204,377 and 928,236, respectively filed June 1, 1978 and July 26, 1978.

BACKGROUND OF THE INVENTION

The present invention generally relates to packaging and more particularly to an apparatus for making unitary packages which hold a plurality of components, each package containing a load wrapped in a web of stretched collapsed film which forms a net-like configuration around the load.

Case packaging or boxing in a common way of shipping multiple unit products. The multiple unit products are generally stacked in a corrugated box or are wrapped with kraft paper with the end of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,549 and 3,514,920. A discussion of this art is set forth in U.S. Pat. No. 3,867,806.

The present invention provides a simple and reliable apparatus for wrapping a load of multiple unit products into a single wrapped package load by using a single strand of stretched overwrap film material that forms a net-like configuration over the load allowing the contents of the load to breathe.

The present apparatus, when compared with other apparatus currently used to pack products in corrugated boxes and the cost of the corrugated boxes themselves, shows an enormous cost savings. In addition to these factors, the invention uses stretch film material, which is less expensive than netting material or perforated stretch film and which also provides product visibility not possible with kraft or corrugated wrapping plus the desirable feature of letting the load "breathe". This feature is especially desirable when live product is packaged and shipped. Furthermore, the present inventive system offers packaging speed, reliability of package seal and energy savings in that less energy is required to package products.

One problem with shrink and non-cling stretch film packaging in addition to the fact that these films do not allow a load to breathe is that the primary strength and reliability of the package is determined by the consistent quality of the seal. These seals depend on a careful maintenance of the sealing jaw and are never as strong as the film itself. The time that it takes to make the seals is a limiting factor on the possible speed of most shrink systems with the additional problem that some stretchable materials, as for example, stretch netting, or narrow film width cannot be effectively heat sealed.

The present invention does not require a structural seal and thereof can use any type of stretchable material. The invention is designed to function with stretchable films such as nylon, polypropylene, P.V.C. or polyethylene which can be stretched in small widths with less force than a stretch net. These films are less expensive than the stretch net. Stretch films which can successfully be used with the apparatus are Mobil X, Mobil C, Mobil H, Mobil Y, Borden PS-26, Consolidated Thermoplastics EVA, Presto, St. Regis and P.P.D.

In these films, the overlying layer of cling film clings to the underlying layer of film.

The present inventive apparatus can also utilize a fastening mechanism which effectively fastens a wrap of collapsed film to an adjacent wrap while severing the trailing edge of the film web from the load after the load has been spirally wrapped to form a package overwrap.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit a spiral overwrap around the load and returns in the opposite direction to deposit another spiral overwrap around the load. Other spiral wrapping apparatus are described by U.S. Pat. Nos. 3,857,486; 3,549,077, 3,412,524; 3,191,289 and 2,716,315.

It has previously been disclosed in U.S. Pat. No. 3,788,199 to spirally wind tapes in a manner that they overlap each other to provide suitable space therebetween when breathability is required. In this reference, a heavy duty bag is prepared by spirally winding stretched tapes of synthetic resin in opposite directions, so that they intersect each other to form a plurality of superimposed bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In this preferred embodiment, the tapes intersect each other at an angle of about 90°. The angle defined by the tapes constituting the cylindrical network may be determined by varying the interrelationship between the travelling speed of the endless belts carrying the tape and the rotating speed of the bobbin holders, which rotate a plurality of tape bobbins to deposit the tape onto the moveable belt.

Various patents have described the use of mechanisms for wrapping materials. In U.S. Pat. No. 3,003,297 a complex cutting and holding mechanism is used to place tape on a box and cut it off with the process being repeated for each box. The use of adhesive on the tape to bond it to the package is an integral part of the function of this concept.

U.S. Pat. No. 2,088,133 discloses a reverse wrapping wire tying machine. In the reference, a gripper mechanism holds a band in position with respect to the load to be wrapped and a rotatable ring drive rotates the band around the load until the band has completed more than one wrap of the load and passes over the body of the gripper mechanism. A separator slide is used to separate the leading edge of the band from the underlying band and a second gripper mechanism attaches to the separated band. A heat sealing mechanism welds the wrapped layer to the band underneath it and a cutting mechanism severs the leading edge of the band held by the second gripper mechanism which then becomes the trailing edge of the succeeding wrap. When the band is severed, the ring drive mechanism is rotated in a reverse direction for the following load with the various gripping and cutting mechanisms functioning in the same manner.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 2,330,629; 2,054,603 and 2,124,770.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown in U.S. Pat. No. 3,986,611 while another apparatus using a tacky P.V.C. film is disclosed in U.S. Pat. No. 3,795,086.

The present invention uses stretchable plastic film in its preferred embodiment since the mechanical stretching of the film utilizes its strength better than heat shrink wrap and at less cost than netting, and can be used on loads where breathing is necessary or no heat can be applied to the product. The elasticity of the collapsed film holds the products under more tension than either the shrink wrap or the kraft wrap, particularly with products which settle or relax when packaged.

Various apparatus and processes have been developed by the named inventors of this invention to utilize stretch material in package wrapping. Such apparatus and processes are disclosed in U.S. Pat. Nos. 3,867,806; 4,050,220; 4,077,179 and 4,079,565.

Additional benefits occur in the present invention over the prior art in that no changeover is required in handling random sized units of a variety of materials as the apparatus is constructed to handle such random size units. Furthermore, the apparatus provides a substantially continuous wrapping operation so that loads can be wrapped at any desired speed and for any time period. A significant economic factor is also present in the invention as the power requirements are significantly less than those of shrink systems since there is no heat tunnel required and greater speeds of operation are possible because of the elimination of the conventional heat seal which is used in non-cling wrapping. Furthermore, a wider number of products can be handled by the present invention because of the elimination of the heat seal requirement. It should also be noted that adhesives do not work efficiently on narrow width film material due to the lack of gripping surface. Because of the simplicity of construction of the invention there is a greater stability in the inventive wrapping apparatus with less maintenance being required to maintain the apparatus resulting in a corresponding reduction in breakdown time. Another desired characteristic resulting from the apparatus construction is that the invention does not take up much floor space.

SUMMARY OF THE INVENTION

The present invention generally comprises a novel apparatus for making spiral wrapped unitary packages having a breathable variable width web overwrap which is not heat sealed.

The leading edge of the film from the film dispenser is tucked in a load resting on the turntable. As the turntable is rotated to wrap the bottom of the load, the film is transported through a rectangularly configured "C" shaped pivotable film orienting mechanism. As the film carriage moves upward the film orienting mechanism is pivoted 90° by a spring assembly varying the film web to reduce its width as it is spirally wrapped around the load. The rectangular film orienting mechanism when it is carried downward by the carriage engages a cam mounted to an upright standard of the frame when it is positioned near the bottom of the load allowing the full film web to be wrapped around the load. The film web is then severed from the film dispenser and attached to a previous film wrap by engaging an overlying layer of cling film to an underlying layer.

The above-mentioned purposes and operations of the invention are more readily apparent when read in conjunction with the following description of the drawings and the detailed description of the preferred embodiment of the present invention.

DETAILED DESCRIPTION OF THE DRAWINGS

Figure 1:
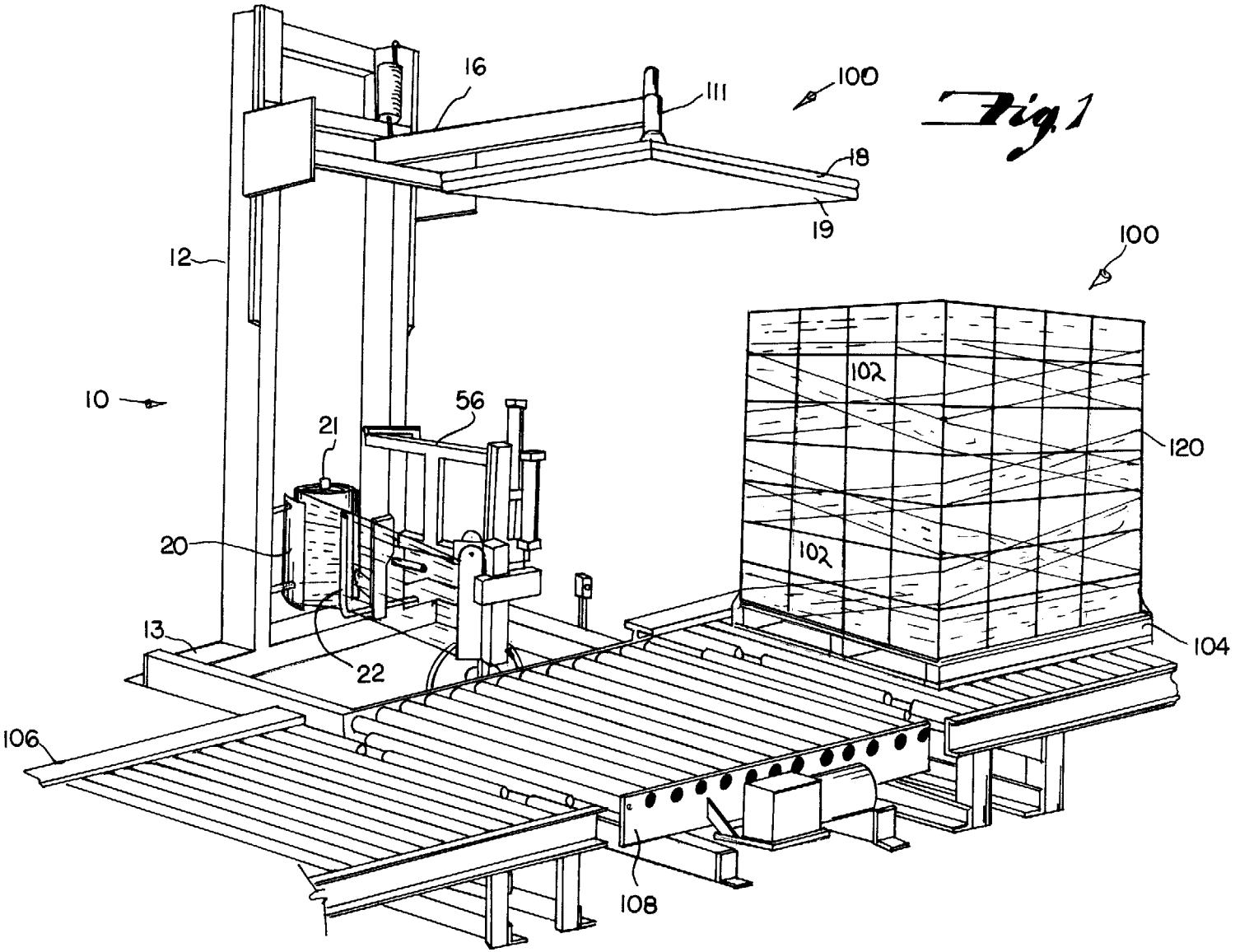
FIG. 1 is a perspective view of the inventive wrapping apparatus.

The spiral wrapping apparatus 10 is shown in FIGS. 1 through 15, and the best mode of the invention is shown in FIG. 1.

The spiral wrapping apparatus 10 comprises an upright frame 12 sitting on a base 13.

A film roll support or carriage 20 is moveably mounted on the frame. The film roll carriage includes a film web varying mechanism 22 and a film roll mandrel or vertical holding member 21 which holds a roll of film mounted on a carriage. The film is formed of linear low density polypropylene, nylon, P.V.C. polypropylene, E.V.A. or other suitable composition ranging from 6" to 30" in width. Stretch films which can be used with the apparatus are Mobil X, Mobil C, Mobil H, Mobil Y, Borden PS-26, Consolidated Thermoplastics E.V.A., Presto, St. Regis and P.P.D. The film roll carriage can be mounted in guides or tracks in the frame and is preferably driven by a rack and pinion drive, although chain, screw or other known drives could be readily adapted to the invention. Film roll carriage drives are well known in the art and examples of such drives are shown by spiral wrap machines manufactured by Lantech Inc., identified by Model Nos. SVS-80, SVSV-80, SVSP-80, STVS-80, STVSP-80 and SAHS-80. The film roll is restricted by the action of a magnetic particle brake (not shown) which is well known in the art and used on the previously indentified Lantech machines which subjects the film material to a braking force causing it to stretch as it is wrapped around a load. The restrictive force is preferably applied by utilizing a roller 23 to engage the outside of the film roll and supply a constant force on the film roll uniformly stretching the film as it leaves the roll.

Figure 3:
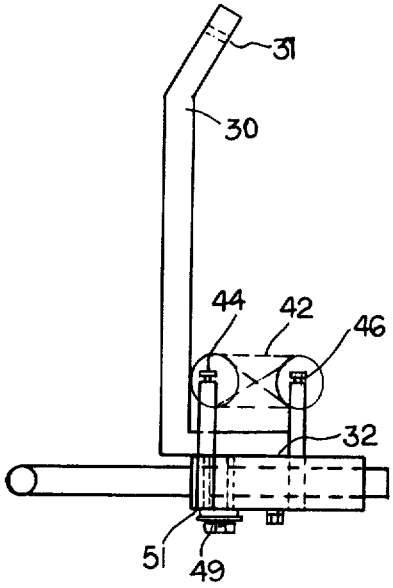
FIG. 3 is a front elevational view of the film web varying mechanism shown in FIG. 1.
Figure 4:
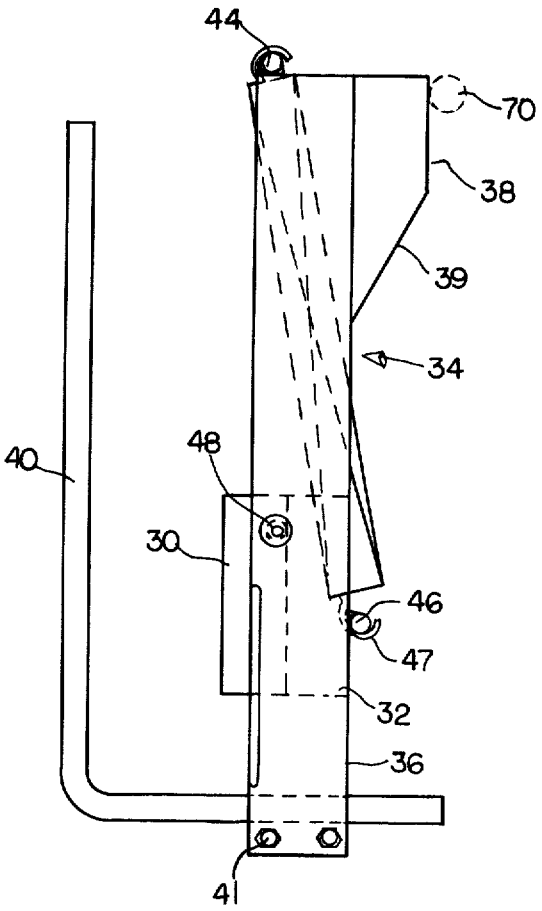
FIG. 4 is a side elevational view of the web varying mechanism of FIG. 3 shown in phantom.
Figure 5:
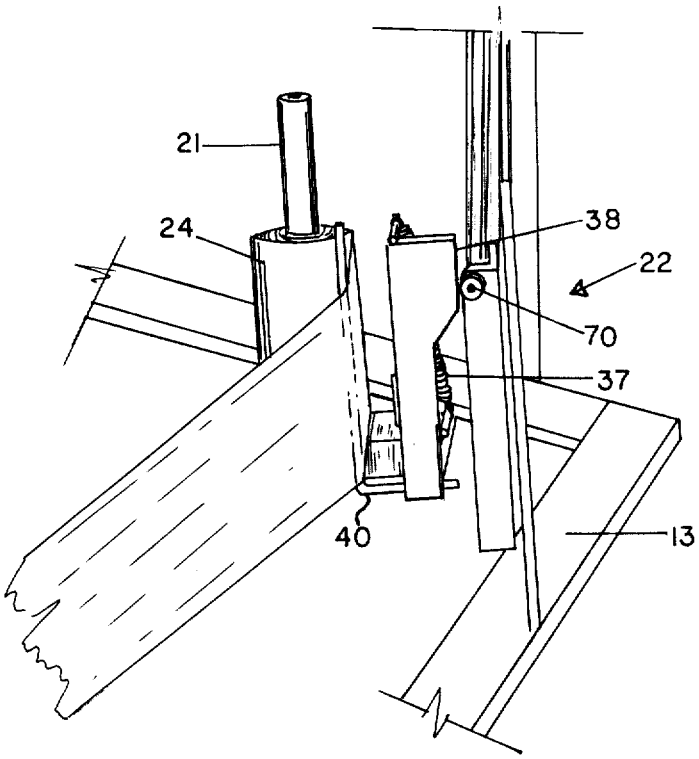
FIG. 5 is a perspective view of the film web varying mechanism after the mechanism has been cammed downwardly showing the film web in an enlarged configuration.
Figure 6:
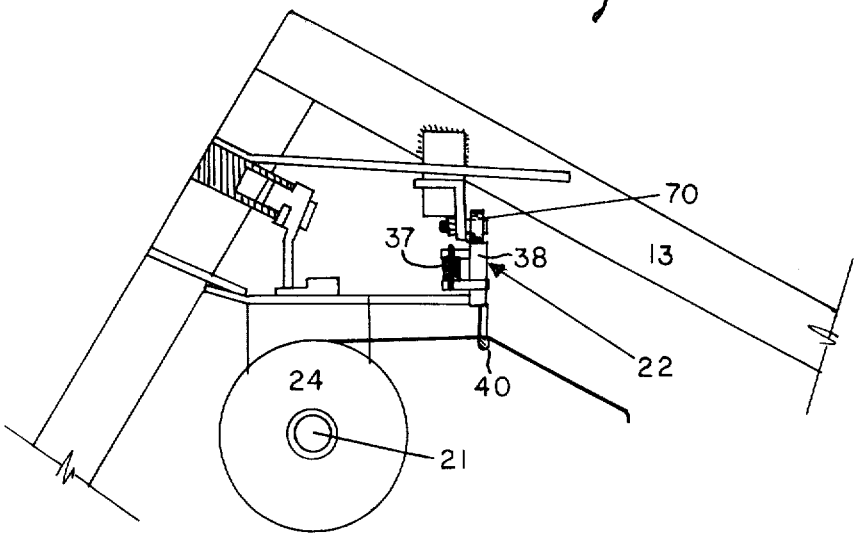
FIG. 6 is an enlarged top plan view partially in section of the film web varying mechanism of FIG. 5.
Figure 7:
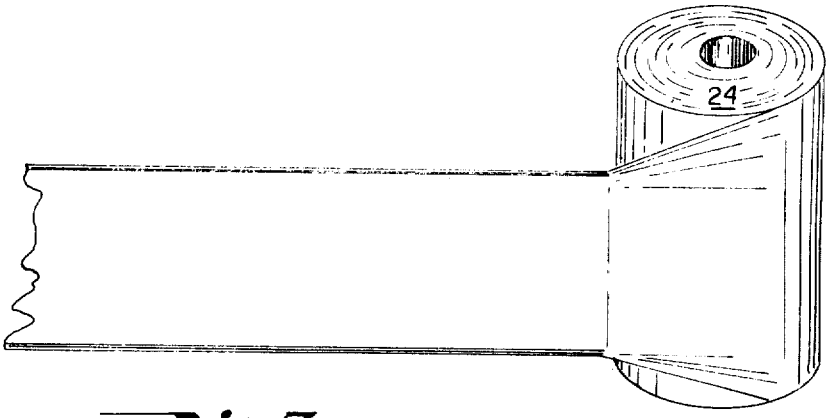
FIG. 7 is a side elevational view of the film web showing the film width reduction when engaged by the mechanism.
Figure 8:
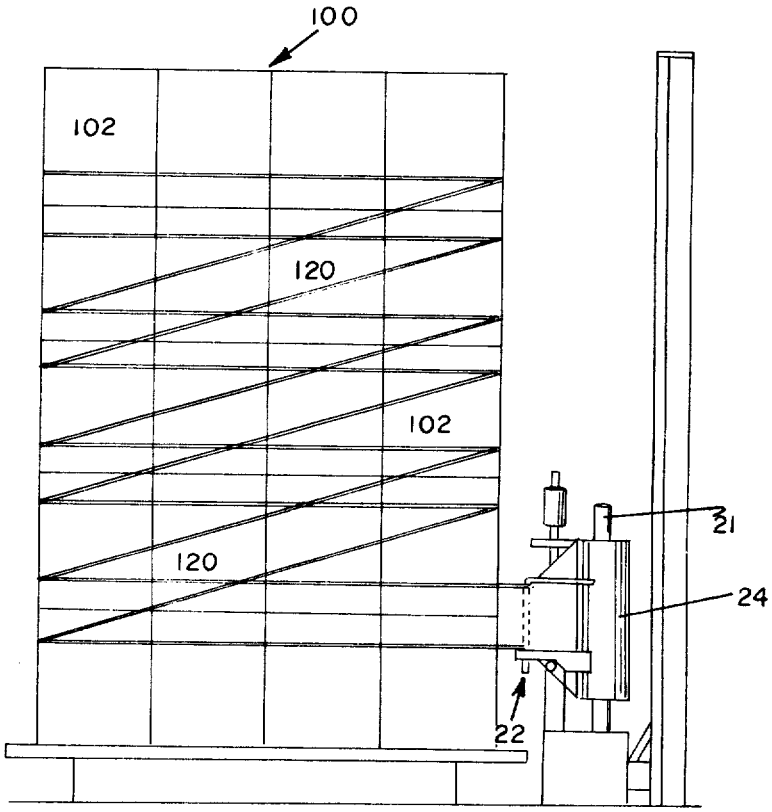
FIG. 8 is a side elevational view of the film width varying mechanism after the mechanism has been moved upwardly, showing the film web in a reduced width configuration.
Figure 9:
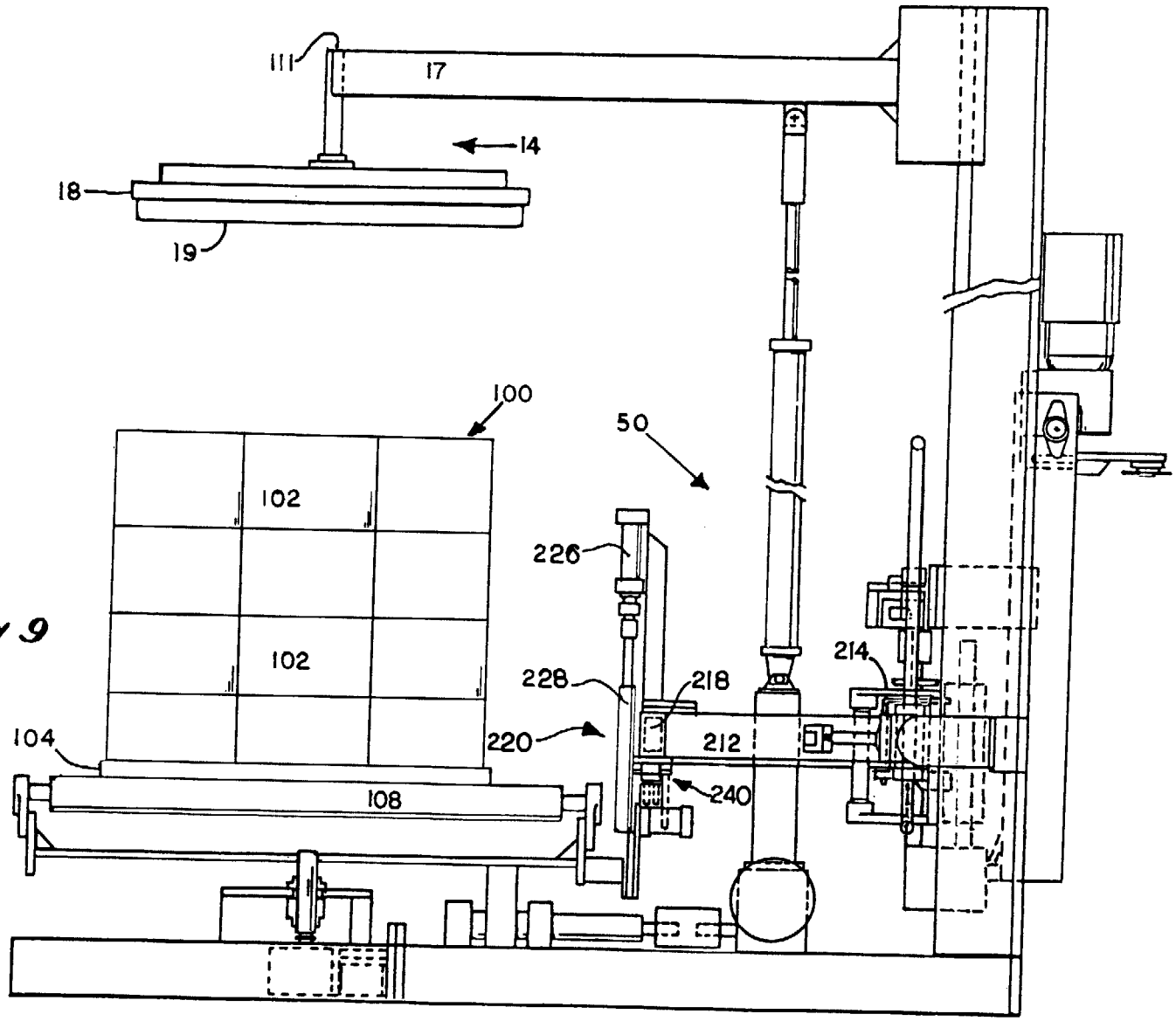
FIG. 9 is a side elevational view of the film fastener embodiment with the film width varying mechanism being schematically shown to enable the components of the fastener assembly to be more clearly seen.
Figure 10:
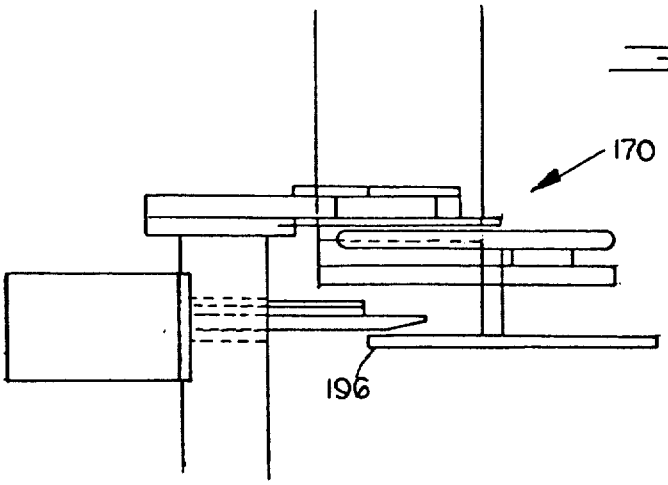
FIG. 10 is an enlarged partial top plan view partially in section of the clamping assembly and tying assembly of the inventive apparatus.
Figure 11:
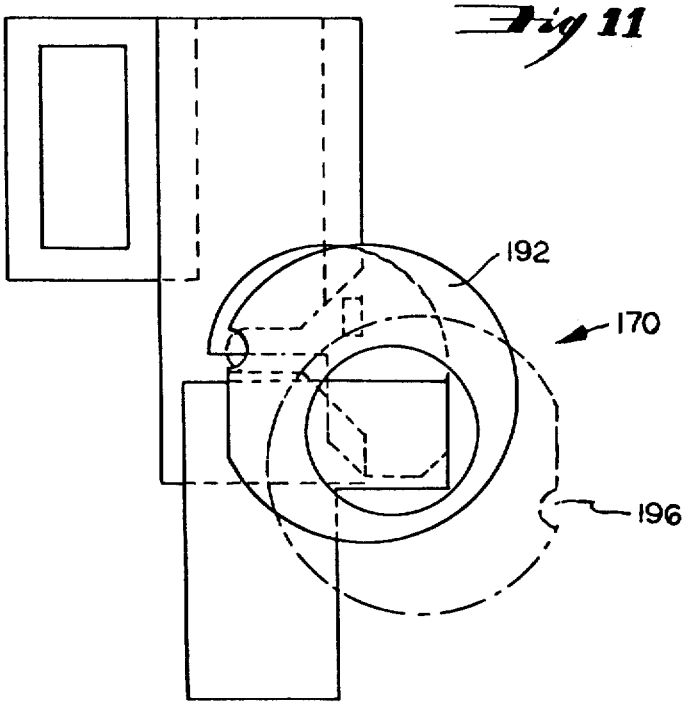
FIG. 11 is a side elevational view of the clamping assembly shown in FIG. 13 showing the position of the assembly when rotated in phantom.
Figure 12:
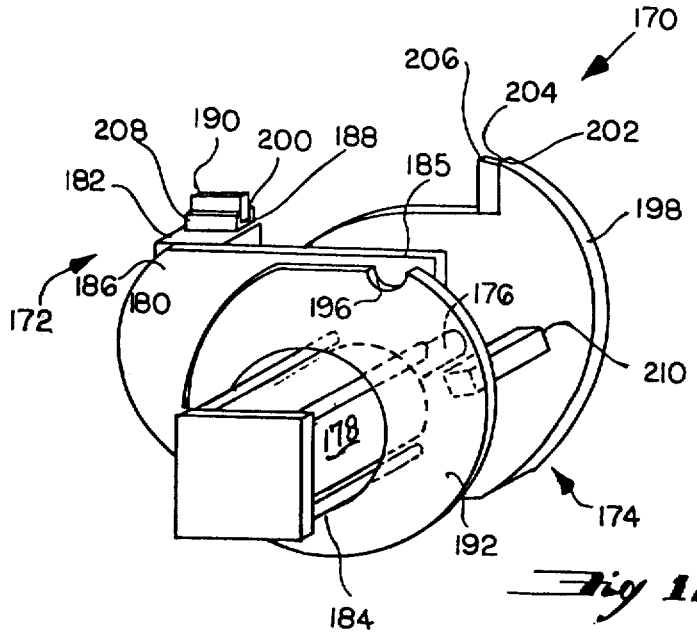
FIG. 12 is an enlarged isolated perspective view of the clamping assembly of the apparatus in an open position.
Figure 15:
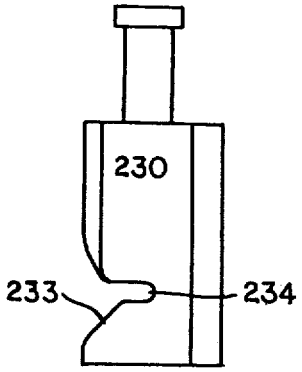
FIG. 15 is a side elevational view of the cutter mechanism housing.
Figure 13:
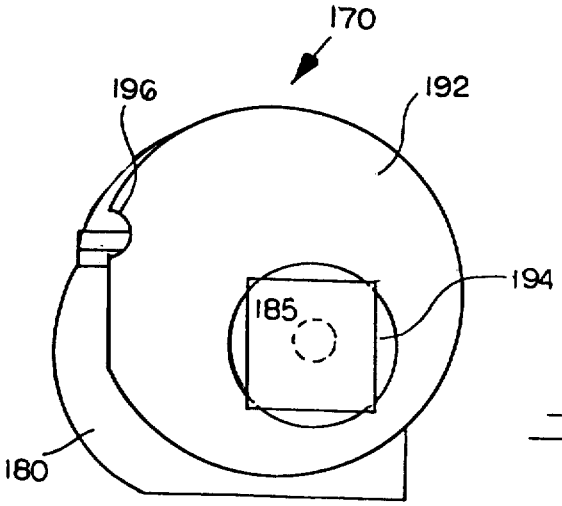
FIG. 13 is a side elevational view of the clamping assembly of the apparatus.
Figure 14:
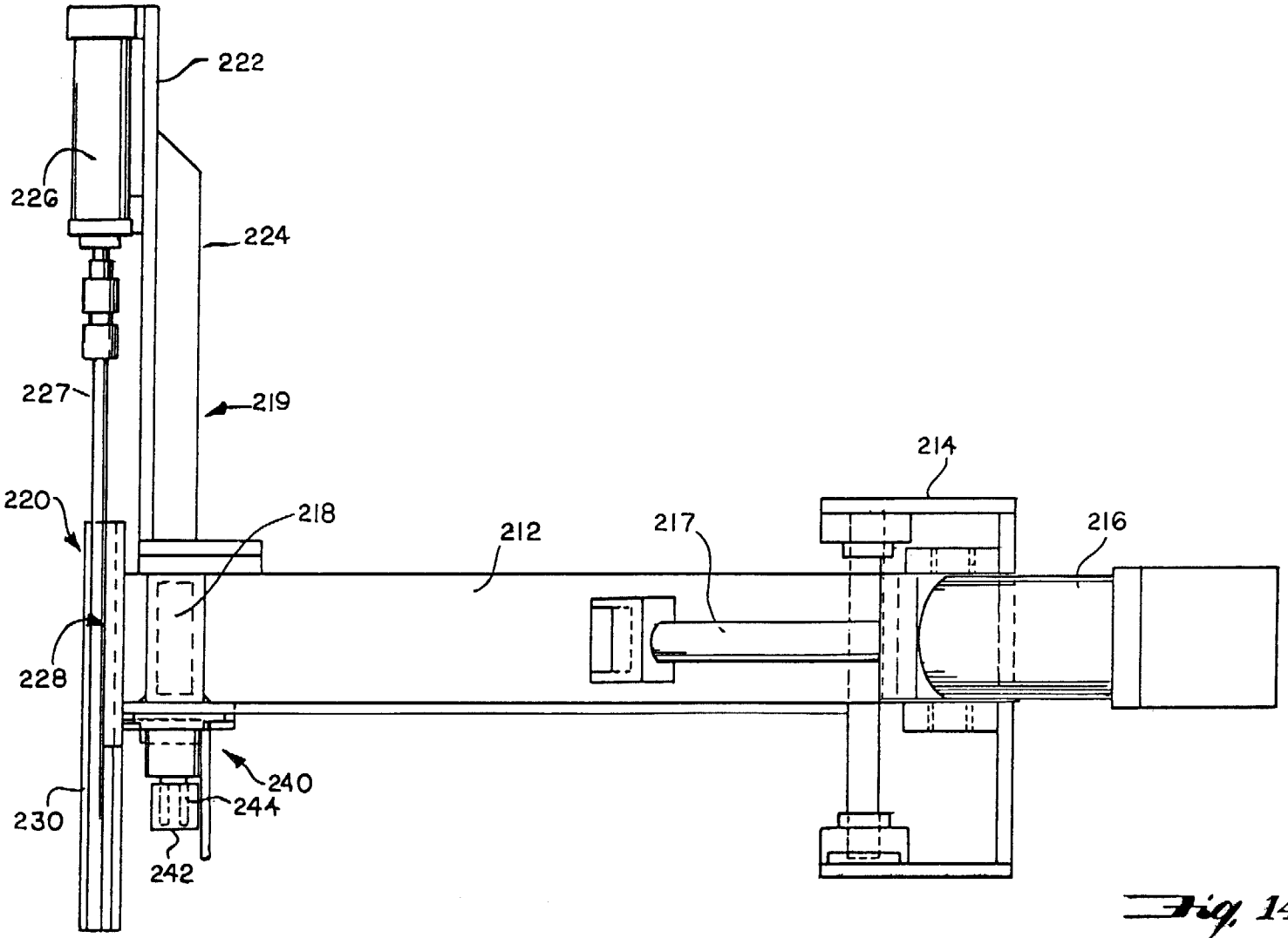
FIG. 14 is an enlarged side elevational view partially in cross-section of the cutter mechanism of the apparatus and the tying assembly of the apparatus.

It should be noted that film and film material are used interchangeably throughout the specification. The film width varying mechanism 22 is used to vary the film width by reducing the web width. In this regard, the film widths used with the invention range from 5" to 30" and are varied so that the film width is reduced from 30% to 70% depending upon the width of the film used. The reduced width film wrapped around the load is severed from the load in the preferred mode by the operator. In an alternate embodiment which will be discussed hereafter, a fastener mechanism 170 is used; however, the film width varying mechanism 22 can be used by itself or with the fastening mechanism. The film as it comes off the film roll 24 is stretched by the brake and passes through the film web width varying mechanism 22. The film web width varying mechanism which is best shown in FIGS. 3 and 4 comprises a connector member 30 which is secured to the film carriage by fastener means extending through aperture 31 in the connector member, a base plate 32 which is secured to the connector member 30 and a web varying assembly 34 which is pivotally mounted on the base plate 32. The web varying assembly 34 comprises a support member 36 with an inclined cam follower 38, an "L" shaped bar 40 mounted in the support member and held in place by bolts 41 and a spring mechanism 42 comprising a spring 37 mounted to upright posts 44 and 46 diagonally positioned from one another with post 44 secured to the support member 36 and post 46 secured to base plate 32. The spring 47 has hooked ends 50 mounted to each post to place the web varying assembly 34 under spring tension. A pivot point 48 formed by a shoulder screw 49 mounted in bushing 51 allows the support member 36 to be pivotally mounted on base plate 32. The normal action of the spring 47 urges the web assembly 34 into a horizontal position where the "L" shaped bar 40 and support member 36 are substantially parallel to the ground.

Figure 2:
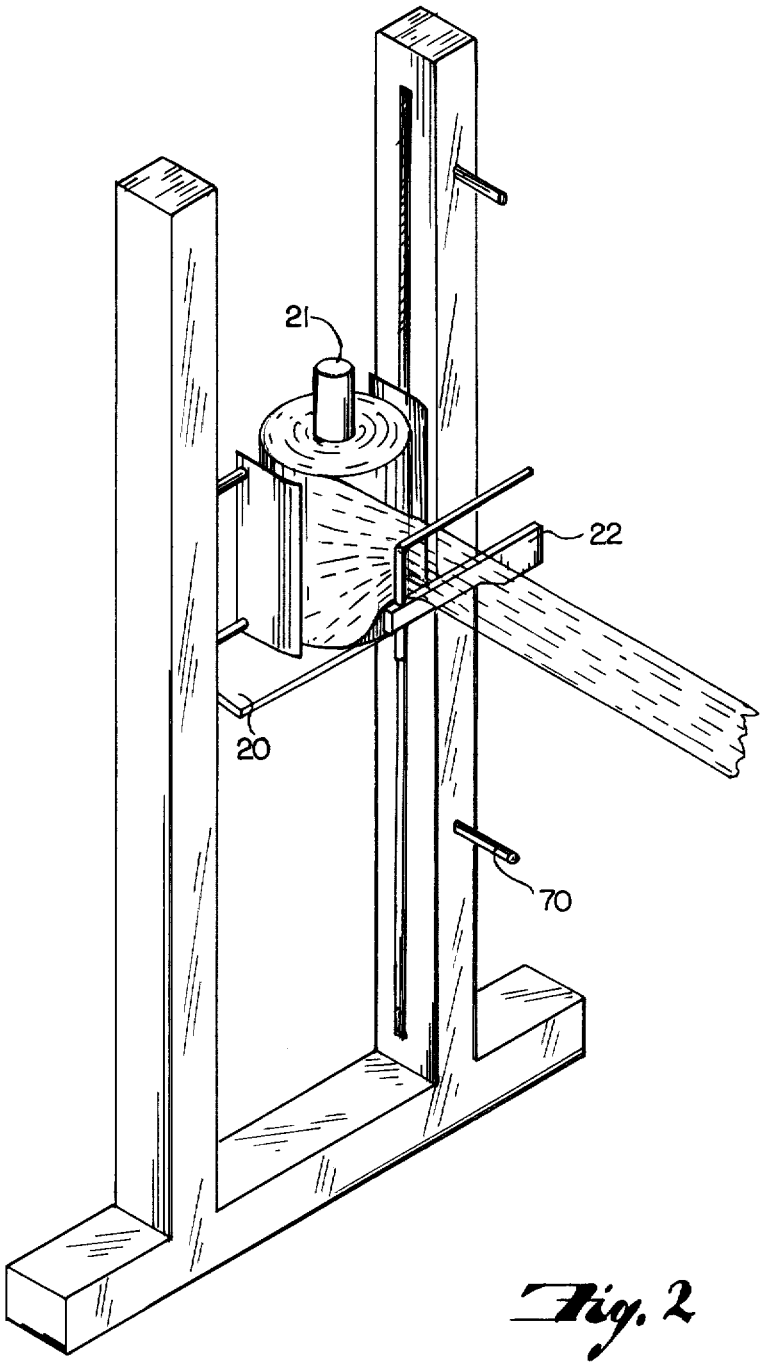
FIG. 2 is an enlarged isolated perspective view of the film web varying mechanism shown in FIG. 1 after it has been spring oriented to reduce the width of the film.

In operation a cam 70 as shown in FIG. 2 and in phantom in FIG. 4 is mounted to an upright standard of the apparatus frame and is engaged by the inclined surface 39 of cam follower 38. The web varying mechanism 22 carried by the film carriage rides along the cam so that it ends up being pivoted 90° against the spring load in the vertical position shown in FIGS. 1 and 4. When the carriage rises from its start position at the bottom of the load it immediately rotates clockwise 90° after it passes cam 70 so that the web width is reduced as shown in FIG. 2. The carriage goes to the top of the load wrapping the load with a reduced film web width and then reverses downward where it engages the cam to pivot it back into a vertical position. This action of the cam 70 on the cam follower 38 brings the web varying assembly into a vertical orientation so that it does not engage the film web allowing the film to be placed around the load in a full web for a desired number of turns. The action of the cam 70 pivots the assembly vertically with the assembly always being urged toward a horizontal position parallel to the ground through the action of spring 47.

In the preferred and best mode of operation of the apparatus, the end of the stretched film webbing is manually pulled through the film width varying mechanism 22 and tucked between units comprising the load or tied to the load pallet.

The load 100 is moved onto the turntable 108 by a power conveyor 106. The turntable is then rotated by an appropriate driving mechanism (not shown) which is well known in the art and breaking force is applied to the web of collapsed stretchable material causing it to be substantially stretched anywhere from 10% to 200%. After one and one half revolutions of the turntable 108 the material roll support carriage 20 is driven upwardly carrying the film width varying mechanism. The film width varying mechanism 22 pivots 90° through the action of its associated spring means as previously stated engaging the film web and reducing its width. When the stretched reduced width film reaches the top of the load 100 the roll carriage stops its upward travel and remains in that position until a number of predetermined wraps are accumulated around the top of the load for stability or packaging reasons. Once the predetermined number of wraps (one or more) have been accumulated around the top of the load, the carriage moves downward carrying the film varying mechanism and its associated roll of film until it reaches its original position thereby covering the load with two spiral intersecting overwraps of reduced width stretched film material defining a plurality of angular spaces forming a symmetrical grid or mesh.

When the carriage reaches the base of the load plate edge 39 engages the cam 70 extending from the upright standard and acts as a cam follower so that a full or opened web will be wrapped around the base of the load.

Alternatively the web width varying mechanism 22 may be cammed at the top of the load by a second cam means shown in FIG. 2 so that the full or opened web of material is wrapped around the top of the load to prevent crushing of delicate cartons. Thus either one of these alternatives is available in the wrapping process of the apparatus or both alternatives are available in the same wrapping cycle, so that a combination wrap of stretched full web material and reduced web stretched material can be used on a single package.

The wrapped load is then conveyed off of the turntable 108 by power conveyor 110 and the next load is conveyed onto the turntable.

In an alternate embodiment shown in FIG. 9 through 15, a platen assembly 14 is mounted on the frame 12 for movement along the frame. The platen assembly comprises a support structure 17 moveably mounted to the frame and a platen 18 moveably mounted to the support structure. The platen has a flexible lower surface 19 which is adapted to be placed on the top of the load 100 comprising a plurality of unitary members 102 stacked on a pallet 104. The lower surface 19 of the platen is lowered onto the top of the load 100 after the load is carried by power conveyor 106 onto turntable 108.

When turntable 108 is rotated the platen rotates within journal 111 of the platen assembly holding the units in position on the load as the spiral wrap 120 is stretch wrapped around the load. The platen provides a force on the units 102 to prevent the units from being displaced or pulled from the load as the stretched film material is wrapped around the load. The film web is pulled from the film roll through the varying mechanism 22 where it is held adjacent the turntable. The film is fastened to an underlying film wrap by fastening mechanism 50.

The film web passes through the film width varying mechanism 22 to a clamping assembly 170 mounted to the edge of the turntable. In the alternate embodiment, the cam 70 is removed from the standard.

The clamp assembly 170 comprises a stationary arm mechanism 172 and a rotatable clamp mechanism 174 mounted to a shaft 176 which is rotated by a rotary pneumatic cylinder 178.

The stationary arm mechanism 172 comprises a support block 180 mounted to turntable 108, a seat support 182 secured to the support block 180 and a cylinder support subassembly 184 secured to the support block. The support block has its rear portion 185 secured to the pneumatic cylinder and its forward portion 186 secured to the stationary seat support 182. The seat support 182 has a "U" shaped seat 188 with a resilient friction member 190 made of rubber or other suitable resilient material secured in the seat and extending above the legs 200 and 208 of the "U" shaped seat 182 for engagement with clamp arm 198 of the rotary clamp mechanism 174. The rotary clamp mechanism 174 comprises a material guide member 192 of an eccentric shape having a circular aperture 194 of suitable diameter surrounding the pneumatic cylinder 174 so that the guide member 192 can freely rotate around the pneumatic cylinder. A curved surface notch 196 is cut inward from the exterior edge of the material guide member 192 a suitable distance which allows the notch to receive and guide the roped material during the tying and severing operation of the apparatus.

The clamp arm 198 is secured to a spacer bar 210 which is secured in turn to the guide member 192. The clamp arm 198 has a cut away segment 202 which approximates a curved "L" shaped surface forming the contact surface for engagement with the resilient friction member 190. The segment 202 has a planar surface 204 adapted to engage the resilient friction member 190 to hold the roped material therebetween. The outwardly extending legs 206 of the "L" is adapted to be positioned adjacent the leg 208 of the seat 188 to engage the stretched material at the smallest angle of extension from the wrapped package.

A cutting mechanism 220 and tying mechanism 240 are secured to a moveable arm 212 which sequentially moves the mechanisms into the path of the material for the severing and tying steps. The arm 212 is rotatably mounted on support structure 214 and is driven by pneumatic cylinder 216 secured to the frame 222. Extension of the piston arm 217 of cylinder 216 drives the arm and the associated cutting and tying mechanism into the material path so that the mechanism can perform its desired function. Secured to the traversing arm 212 are a perpendicularly extending arm 218 which holds the tying mechanism 240 and a support structure 219 which is mounted to the top of the arm and supports the cutting mechanism 220. The cutting mechanism 220 comprises an upright support plate 222 and traverse brace 224 secured to the support plate and a piston 226 which is secured to the upright support plate 222. A piston arm 227 extends from the piston, the distal end of which is secured to the cutting blade 228. The cutting blade 228 is reciprocally positioned in a guillotine sheath or housing 230 which is secured to the end of traversing arm 212. The guillotine sheath 230 comprises a plate structure having an inwardly inclined notch 233 cut into one side adapted to receive the roped material and direct it into a center of the notch 234. The roped material when held in cutting notch 234 is severed by reciprocating action of the cutting blade 228 striking the roped material and cutting through the rope material.

A standard hog ringer device 242 such as that made by ATRO Company, types I and C, is secured to the lower part of arm 219. A magazine 244 extends perpendicularly from the mechanism to feed staples or hog rings into the mechanism. In operation of such a standard hog ringer the shaped nose of the hog ring engages the materials to be tied together and a ring or staple is driven around the material held in the nose of the ring and fastened around materials by bending the ring or staple around the items to be tied. Thus, the two roped web layers which have been placed side by side are fastened together through the action of the hog ring passing a staple around both of the ropes and fastening or tying them together through the contraction of the staple or bending of the staple or ring around the materials.

It should be understood that the examples are not meant to limit the invention in any manner nor is the invention limited to any one embodiment described herein; on the contrary, it is intended to cover all alternatives, modifications and equivalents as may be included within the spirit and scope of the invention as defined by the appended claims.

What is claimed is:

1. An apparatus for packaging a load with a cling type plastic film comprising a frame, a carriage moveably mounted on said frame, said carriage being adapted to hold a roll of stretchable film material for rotation, a turntable adapted to support a load positioned adjacent said frame, drive means connected to said turntable and adapted to rotate said turntable and an associated load mounted on said turntable to cause a web of film material to be pulled from a roll of film material held by said carriage to overwrap said load, restriction means adapted to restrict movement of the web of film material from said roll so that said material is stretched over 10% as it leaves said roll, a film width varying means mounted in the film material path so that the film web travels through said film varying means, said film width varying means comprising a substantially "U" shaped mechanism with fixed parallel legs, means to transport said mechanism into selected positions, said mechanism being adapted to be transported into at least two positions, one of said positions orienting said parallel legs transverse to the plane of the film web collapsing the film web into a roped configuration, another of said positions orienting said parallel legs substantially parallel to the plane of the film web allowing the film web to be transported through the mechanism without collapsing the film web.

2. An apparatus as claimed in claim 1 wherein said plastic film is a linear low density polyethylene film.

3. An apparatus for making a unitary package comprising a frame, a carriage moveably mounted on said frame, a roll of stretchable material rotatably mounted on said carriage, restriction means adapted to restrict the material being dispensed from the material roll stretching the same, a turntable adapted to support a load positioned adjacent to said frame, drive means connected to said turntable and adapted to rotate said turntable and an associated load placed on said turntable causing stretched material from said roll of material held by said carriage placed proximate said load to overwrap said load, means to selectively vary said material web width mounted to said carriage, said web width varying mechanism comprising a moveable support means and a plurality of fixed arms secured to and extending from said support means with said web passing between said arm means to move said web varying mechanism to a first position where the longitudinal axis of said fixed arms are oriented substantially parallel to the plane of the film and said arm do not engage the film web to change the web width allowing the film web to be transported through the mechanism in a substantially planar configuration; and from said first position to a second different position where the fixed arms are transverse to the plane of the web to engage the web width and collapsing the web into a roped configuration.

4. An apparatus as claimed in claim 3 wherein said moving means comprises spring means constantly urging said web width varying means into one position and cam means acting against said spring means to drive said web width varying means into another position.

5. An apparatus for making a unitary package comprising a vertical frame, a carriage moveably mounted on said frame, a roll of stretchable film material rotatably mounted on said carriage, restriction means to restrict the material being dispensed from said film roll stretching the same, a turntable adapted to support a load positioned adjacent to said frame, drive means connected to said turntable and adapted to rotate said turntable and an associated load placed on said turntable causing stretched film from said roll of film material held by said carriage to overwrap said load, means to selectively vary said film web width positioned adjacent said frame and mounted to said carriage, said film web varying means being pivotally mounted and placed so that it will allow the web width of film material to pass through it in one position without engaging said film while reducing the width of the web of stretched film passing through it in another position, said film web varying means comprising a film engaging assembly, connecting means connecting said film engaging assembly to said carriage, said film engaging assembly comprising a base member pivotally mounted to said connecting means, an extension member mounted to said base member and extending from said member to define an area between said members through which said film web can pass and spring means connected to said base member and said connecting means placing said base member under spring tension causing it to assume a predetermined position said film varying means including cam means secured to said frame and cam follower means secured to said base member to move said film web width varying means to assume at least two distinct positions, one of said positions allowing the film web to travel through it in a planar configuration and the other position collapsing the film web to reduce its width.

6. An apparatus as claimed in claim 5 wherein said spring means comprises diagonally aligned posts mounted to said base plate and a tensioned spring mounted to said posts.

7. An apparatus as claimed in claim 5 wherein said extension member comprises an "L" shaped arm mounted to said base plate.

8. An apparatus as claimed in claim 5 wherein said cam means comprises a member secured to said frame and extending outward from said frame.

9. An apparatus for wrapping a plurality of units with an overwrap comprising a vertical frame, a carriage moveably mounted on said frame, a roll of stretchable material rotatably mounted on said carriage, brake means connected to said roll of stretchable material to restrict the material being dispensed from the roll stretching the same, a turntable adapted to support a load positioned adjacent to said frame, drive means connected to said turntable and adapted to rotate said turntable and an associated load placed on said turntable causing stretched material from said roll of material held by said carriage to overwrap said load, means to selectively vary the width of the web of stretched material, said web width varying means comprising support means secured to said frame, a web reducing assembly pivotally mounted to said support means, said web reducing assembly comprising a support bar and to said supporting means, spring means mounted to said support bar to urge said support bar into a predetermined position, a film arm mounted to said support bar, said film arm including a film restriction portion extending substantially parallel to the surface of said support bar forming a substantially enclosed area through which the stretched material travels and cam means mounted on said frame to move said web reducing assembly into a position which is different from its previous position, one of said positions bringing said support bar and film arm into engagement with the film material to reduce its width, and means mounted downstream from said web reducing assembly to receive reduced web width material and hold said material in a clamped relationship after the material has been wrapped around said load, and means to sever said material from said dispenser roll.

10. An apparatus as claimed in claim 9 including a second cam means to move said web reducing assembly into a position which is different from its previous position.

* * * * *